US011692451B1

(12) United States Patent
St-Laurent

(10) Patent No.: US 11,692,451 B1
(45) Date of Patent: Jul. 4, 2023

(54) AIRCRAFT ENGINE WITH RADIAL CLEARANCE BETWEEN SEAL AND DEFLECTOR

(71) Applicant: PRATT & WHITNEY CANADA CORP., Longueuil (CA)

(72) Inventor: Gabriel St-Laurent, Longueuil (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/656,813

(22) Filed: Mar. 28, 2022

(51) Int. Cl.
*F01D 11/02* (2006.01)

(52) U.S. Cl.
CPC ..... *F01D 11/02* (2013.01); *F05D 2240/60* (2013.01)

(58) Field of Classification Search
CPC ..... F01D 11/00; F01D 11/001; F01D 11/02; F01D 11/025; F01D 5/06; F16J 15/44; F16J 15/441; F16J 15/442; F16J 15/443; F16J 15/444; F16J 15/445; F16J 15/447; F16J 15/4472; F05D 2240/55; F05D 2240/60
See application file for complete search history.

(56) References Cited

U.S. PATENT DOCUMENTS 5,211,535 A 5/1993 Martin et al.
5,218,816 A * 6/1993 Plemmons ..... F01D 11/02 415/174.5
8,784,045 B2 7/2014 Zoric et al.
2005/0111967 A1* 5/2005 Couture ..... F01D 11/001 415/173.4
2006/0034685 A1* 2/2006 Kizuka ..... F01D 11/001 415/191
2013/0129493 A1* 5/2013 Matsumoto ..... F01D 5/12 416/191
2013/0189107 A1* 7/2013 Krishnan ..... F01D 11/001 416/193 R
2016/0130966 A1* 5/2016 Shorney ..... F04D 29/102 277/412
2020/0157957 A1* 5/2020 Momma ..... F01D 9/041
2022/0275731 A1* 9/2022 Girardeau ..... F01D 11/122

* cited by examiner

*Primary Examiner* — Woody A Lee, Jr.
*Assistant Examiner* — Elton K Wong
(74) *Attorney, Agent, or Firm* — Norton Rose Bulbright Canada LLP.

(57) ABSTRACT

An aircraft engine has: a first component and a second component coaxially mounted about a central axis; a flow passage extending within an annular gap defined radially between the first component and the second component, the flow passage fluidly connecting a first zone to a second zone; a seal disposed in the flow passage between the first zone and the second zone, the seal extending from a seal base secured to the first component to a seal end radially spaced apart from the seal base; a deflector located downstream of the seal relative to a first flow flowing from the first zone to the second zone through the seal, the deflector extending from a deflector base secured to the second component to a deflector end radially spaced apart from the deflector base; and a radial gap defined radially between the seal end and the deflector end.

18 Claims, 5 Drawing Sheets

AIRCRAFT ENGINE WITH RADIAL CLEARANCE BETWEEN SEAL AND DEFLECTOR

TECHNICAL FIELD

The application relates generally to aircraft engines and, more particularly, to labyrinth seals used in such engines and assembly features of such engines.

BACKGROUND

In an aircraft engine, such as a gas turbine engine, seals are used to separate cavities containing air at different pressures. Seals, such as a labyrinth seal, are typically used to limit leakage of air from one cavity to another, at locations where relative movement between components is either necessary or advisable. A radial clearance of the seal may be non-uniform circumferentially. Hence, a radial gap defined by the seal may be greater at a given circumferential location than at other circumferential locations. This may create a greater flow through the seal at this given circumferential location. In situations where the flow of air is hot (or cold) relative to the downstream cavity, an increased mass flow air at this location may result in a circumferential region of a component downstream of the seal being hotter (or colder) than other circumferential regions. In turn, this may create thermal gradients within the component. Improvements are therefore sought.

SUMMARY

In one aspect, there is provided an aircraft engine comprising: a first component and a second component coaxially mounted about a central axis; a flow passage extending within an annular gap defined radially between the first component and the second component, the flow passage fluidly connecting a first zone to a second zone; a seal disposed in the flow passage between the first zone and the second zone, the seal extending from a seal base secured to the first component to a seal end radially spaced apart from the seal base; a deflector located downstream of the seal relative to a first flow flowing from the first zone to the second zone through the seal, the deflector extending from a deflector base secured to the second component to a deflector end radially spaced apart from the deflector base; and a radial gap defined radially between the seal end and the deflector end.

The aircraft engine may include any of the following features, in any combinations.

In some embodiments, the second component defines a recessed section in a radial direction relative to the central axis, the deflector secured to or integral to the recessed section.

In some embodiments, the second component defines a seal land facing the seal, a radial distance between the recessed section and the seal end greater than a radial clearance defined between the seal land and the seal end.

In some embodiments, the second component defines a sloped section connecting a seal land facing the seal to the recessed section.

In some embodiments, an angle defined between the sloped section and the seal land is selected to avoid detachment of the first flow flowing along the sloped section.

In some embodiments, the flow passage receives the first flow from the first zone, receives a second flow at a temperature different than that of the first flow, the flow passage has an outlet receiving a mixture of the first flow and the second flow.

In some embodiments, the outlet is located downstream of the deflector relative to the first flow.

In some embodiments, the seal is a labyrinth seal, a controlled gap seal, a carbon seal, or a brush seal.

In some embodiments, the first component is located radially outwardly of the second component.

In some embodiments, the first component is rotating about the central axis.

In some embodiments, the second component is located radially outwardly of the first component.

In another aspect, there is provided a compressor section, comprising: a rotor defining a bore; a shaft extending through the bore; a flow passage in fluid flow communication with an annular gap defined radially between the rotor and the shaft, the flow passage fluidly connecting a first zone and a second zone; a seal disposed in the flow passage between the first zone and the second zone, the seal extending from a seal base secured to one of the rotor and the shaft to a seal end radially spaced apart from the seal base; a deflector located downstream of the seal relative to a first flow of air flowing from the first zone to the second zone through the seal, the deflector extending from a deflector base secured to the other of the rotor and the shaft to a deflector end radially spaced apart from the deflector base; and a radial gap defined radially between the seal end and the deflector end.

The compressor section may include any of the following features, in any combinations.

In some embodiments, the other of the rotor and the shaft defines a recessed section, the deflector secured to the recessed section.

In some embodiments, the other of the rotor and the shaft defines a seal land facing the seal, a radial distance between the recessed section and the seal end greater than a radial clearance defined between the seal land and the seal end.

In some embodiments, the other of the rotor and the shaft defines a sloped section connecting a seal land facing the seal and the recessed section.

In some embodiments, an angle defined between the sloped section and the seal land is selected to avoid detachment of the first flow of air flowing along the sloped section.

In some embodiments, the flow passage receives the first flow from the first zone, receives a second flow at a temperature different than that of the first flow, the flow passage has an outlet receiving a mixture of the first flow and the second flow.

In some embodiments, the outlet is located downstream of the deflector relative to the first flow.

In some embodiments, the seal is secured to the rotor and the deflector is secured to or integral to the shaft.

In another aspect, there is provided turbine section, comprising: a rotor defining a bore; a shaft extending through the bore; a flow passage in fluid flow communication with an annular gap defined radially between the rotor and the shaft, the flow passage fluidly connecting a first zone and a second zone; a seal disposed in the flow passage between the first zone and the second zone, the seal extending from a seal base secured to one of the rotor and the shaft to a seal end radially spaced apart from the seal base; a deflector located downstream of the seal relative to a first flow of air flowing from the first zone to the second zone through the seal, the deflector extending from a deflector base secured to the other of the rotor and the shaft to a deflector end radially spaced apart from the deflector base; and a radial gap defined radially between the seal end and the deflector end.

BRIEF DESCRIPTION OF THE DRAWINGS

Reference is now made to the accompanying figures in which.

DETAILED DESCRIPTION

Figure 1:
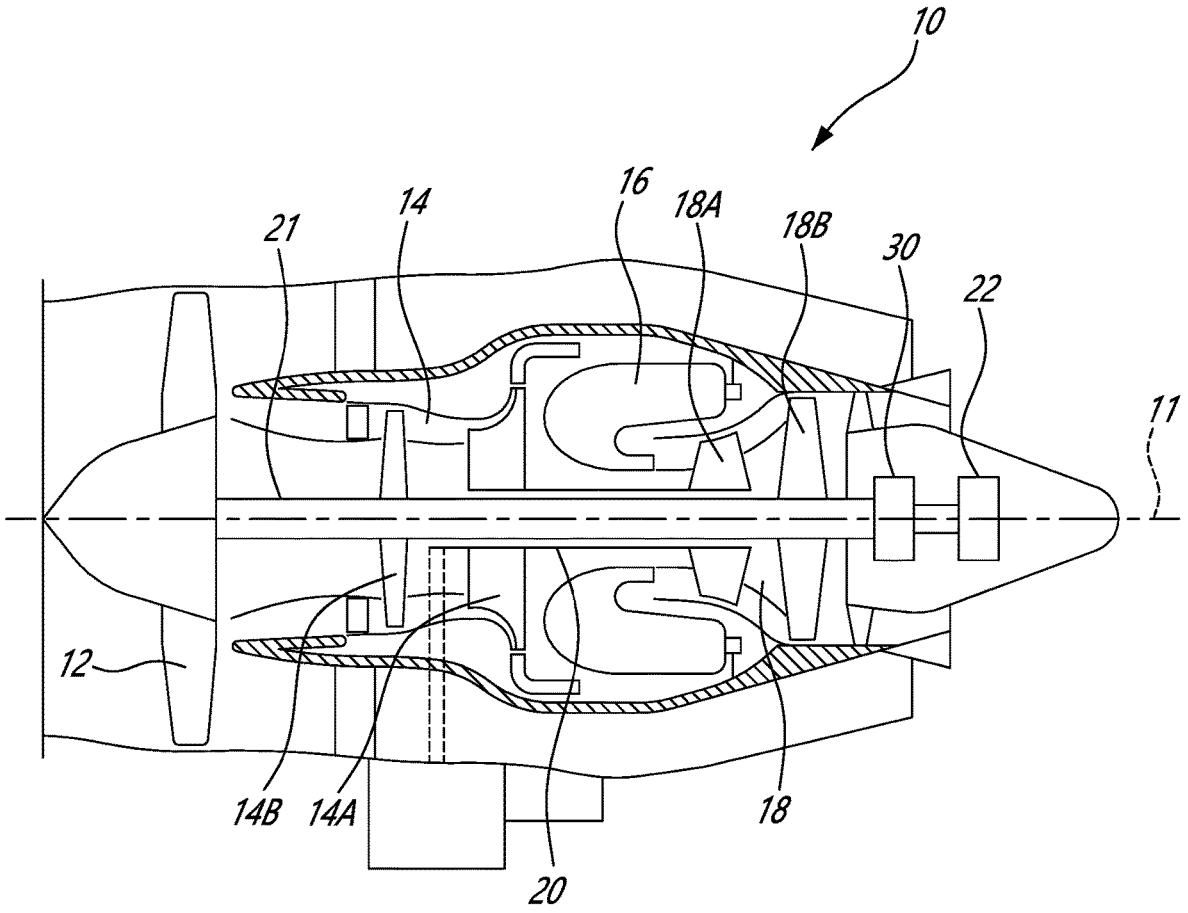
FIG. 1 is a schematic cross sectional view of an aircraft engine depicted as a gas turbine engine.

FIG. 1 illustrates an aircraft engine depicted as a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the gas turbine engine 10. In the embodiment shown, the gas turbine engine 10 comprises a high-pressure spool having a high-pressure shaft 20 drivingly engaging a high-pressure turbine 18A of the turbine section 18 to a high-pressure compressor 14A of the compressor section 14, and a low-pressure spool having a low-pressure shaft 21 drivingly engaging a low-pressure turbine 18B of the turbine section to a low-pressure compressor 14B of the compressor section 14 and drivingly engaged to the fan 12. It will be understood that the contents of the present disclosure may be applicable to any suitable engines, such as electric hybrid engines and reciprocating engines, such as piston and rotary engines without departing from the scope of the present disclosure.

Although illustrated as a turbofan engine, the gas turbine engine 10 may alternatively be another type of engine, for example a turboshaft or a turboprop engine, also generally comprising in serial flow communication a compressor section, a combustor, and a turbine section, and a propeller through which ambient air is propelled. In addition, although the engine 10 is described herein for flight applications, it should be understood that other uses, such as industrial or the like, may apply.

Figure 2:
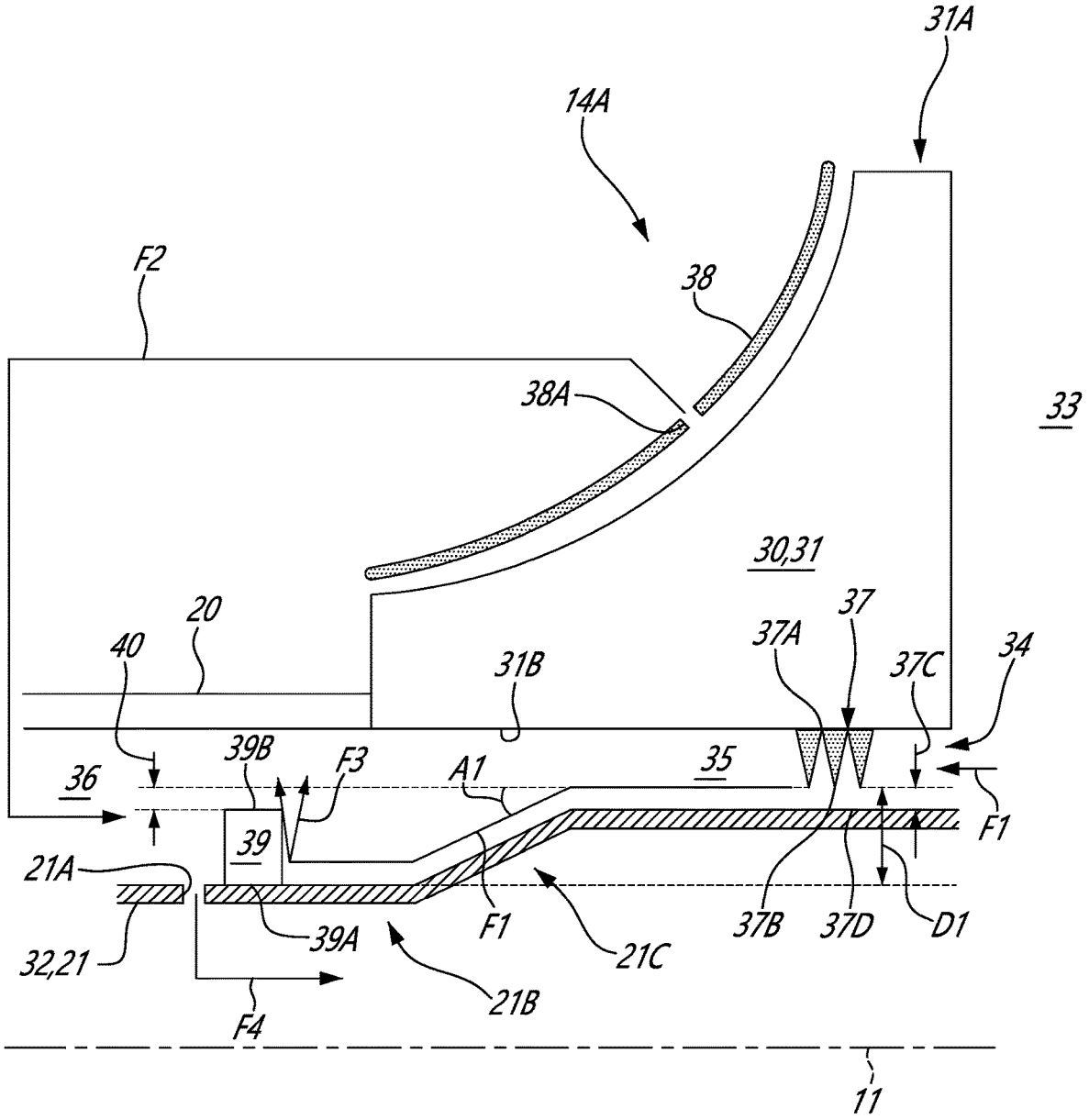
FIG. 2 is a schematic view of a compressor section of the gas turbine engine of FIG. 1 illustrating an integration of a seal and a deflector in accordance with one embodiment.

Referring now to FIG. 2, a portion of the compressor section 14 is shown. The compressor section 14 includes a first component 30, which herein corresponds to an impeller 31 of the high-pressure compressor 14A, and a second component 32, which herein corresponds to the low-pressure shaft 21. In another embodiment, the high-pressure compressor 14A may include an axial compressor instead of the impeller 31. It will be appreciated that the principles of the present disclosure applies to any two components that are coaxial and that are axially overlapping one another. For instance, the two components may be two shafts, a rotor and a stator, and so on. The two components 31, 32 may be both rotating, either at the same speed or at different speeds; one of the two components may be rotating while the other is static; both of the two components may be static. The impeller 31 is drivingly engaged by the high-pressure shaft 20. Hence, the first component 30 or impeller 31 is rotatable relative to the second component 32 or low-pressure shaft 21. The principles of the present disclosure may also apply to the turbine section 18 of the gas turbine engine 10 as will be described below.

In use, the impeller 31 compresses an airflow flowing between blades of the impeller 31 and outputs a flow of compressed air at an outlet 31A of the impeller 31. A portion of the compressed air exiting the impeller 31 flows to the combustor section 16 for combustion. Another portion of the compressed air flows within a secondary air system, which uses the air, for instance, for pressurizing bearing cavities, cooling components, and so on. The secondary air system may include a first zone 33 that receives this other portion of the compressed air before delivering it to locations in need of pressurization and/or cooling. In the embodiment shown, the compressed air in the first zone 33 flows within a flow passage 34 along flow direction F1. The flow passage 34 extends within an annular gap 35 defined radially between a peripheral face 31B circumscribing a bore of the impeller 31 and the low-pressure shaft 21. The flow passage 34 leads to a second zone 36 being at a pressure less than that of the first zone 33.

To allow relative motion between the impeller 31 and the low-pressure shaft 21 while limiting a flow between the first zone 33 and the second zone 36, a seal 37 is used. The seal 37 is in fluid flow communication with the flow passage 34 and limits a flow rate of the air flowing along the flow direction F1 from the first zone 33 to the second zone 36. The seal 37 extends in a direction having a radial component relative to the central axis 11 from a seal base 37A to a seal end 37B being radially spaced apart from the seal base 37A. Herein, the seal 37 extends in a radially inward direction. The seal 37 is depicted here as a labyrinth seal having a series of axially spaced-apart teeth. However, any suitable seal may be used, such as, for instance, a controlled gap seal, a carbon seal, a brush seal, and so on. In the embodiment shown, the seal 37 is secured to the peripheral face 31B of the impeller 31, but may alternatively be secured to the high-pressure shaft 20. In another embodiment, the seal 37 may be secured to the low-pressure shaft 21 and may extend in a radially outward direction.

The seal 37 defines a seal clearance 37C, which corresponds to a gap defined radially from the seal end 37B to a seal land 37D facing the seal 37. In the present case, the seal land 37D is defined by a face of the low-pressure shaft 21. In some embodiments, the seal land 37D may be defined by another component, such as a sleeve, secured to the low-pressure shaft 21.

The seal clearance 37C may be axisymmetric. That is, the seal clearance 37C may be constant all around the central axis 11. However, assembly and manufacturing tolerances of any of these components, or alternatively deflections resulting from engine operation, may create locations around the central axis 11 where the seal clearance 37C is greater than that at other locations. In use, the compressed air that flows through the seal 37 is at a high temperature since it went through a compressing process via its passage through the impeller 31. A greater flow rate is expected at the locations where the seal clearance 37C is greater. This, in turn, creates more hot air flowing past certain circumferential portions of either the impeller 31 and the low-pressure shaft 21 and less hot air flowing past other circumferential portions. These components may therefore exhibit circumferential thermal gradients, which may be undesired. These may be further exacerbated because the flow that flows past the seal 37 may tend to stick to the low-pressure shaft 21 because of the Coanda effect.

The hot air flowing along the flow direction F1 is mixed with cooler air bled from the high-pressure compressor 14A, or bled from any other source, for instance, from the low-pressure compressor 14B. More specifically, in the embodiment shown, a shroud 38 extends circumferentially around the impeller 31. The shroud 38 may define a bleed outlet 38A via which air may be bled from the high-pressure compressor 14A for use by the secondary air system. A flow of bled air flows around a second flow direction F2 from the bleed outlet 38A and is injected inside the flow passage 34 downstream of the seal 37 relative to flow direction F1.

Because of the uneven circumferential gap and flow distribution at the seal 37, it may be difficult to mix the cooler air from the bleed outlet 38A with the compressed air from the first zone 33. A deflector 39 is used and may help in increasing mixing efficiency. The deflector 39 may be annularly extending around a full circumference of the low-pressure shaft 21. The deflector 39 may be axisymmetric. In other embodiments, the deflector 39 may include a plurality of deflector sections circumferentially interspaced about the central axis 11. The deflector 39 is located downstream of the seal 37 relative to the air flowing in the flow direction F1 from the first zone 33 to the second zone 36. The deflector 39 has a deflector base 39A secured to the low-pressure shaft 21 and a deflector end 39B radially spaced apart from the deflector base 39A. The deflector 39 may extend in a radially outward direction relative to the central axis 11. A radial height of the deflector 39 is selected to be at least as high as a thickness of a boundary layer of the flow reaching the deflector 39. The deflector 39 and the seal 37 therefore extend in radially opposite directions. The deflector 39 may break the Coanda effect to deflect the flow in a radially outward direction along a third flow direction F3. The deflector 39 therefore extends transversally to a direction of the flow downstream of the seal 37. The deflector 39 may therefore facilitate the mixing between the flows flowing along second directions F2 and third direction F3.

The mix of the cooler bled air providing from the bleed outlet 38A and the hot air from the first zone 33 may flow through an outlet 21A defined by the low-pressure shaft 21. This mixture of cooler and hotter air may flow along a fourth flow direction F4 within an internal passage of the low-pressure shaft 21 to reach locations in need of pressurizing and/or cooling. These locations may include, for instance, bearing housings, turbine rotors, turbine shrouds, and so on. The outlet 21A may be located downstream of the deflector 39 relative to the flow direction F1.

However, the presence of both of the deflector 39 and of the seal 37 may create a radial interference. This may be problematic for assembling parts of the gas turbine engine 10. More specifically, in the present embodiment, the low-pressure shaft 21 may require to be inserted through the bore of the impeller 31. This may be prevented by the deflector that may partially radially overlap the seal.

In the present embodiment, this problem may be alleviated by providing a positive radial gap or clearance 40 defined radially between the seal end 37B and the deflector end 39B such that an axial movement of the low-pressure shaft 21 relative to the impeller 31 is permitted during an assembly process that may require the deflector end 39B to pass underneath the seal end 37B.

In the embodiment shown, the low-pressure shaft 21 defines a recessed section 21B. The deflector 39 is secured to the recessed section 21B. A radial distance D1 between the recessed section 21B and the seal end 37B is greater than the seal clearance 37C, which is defined between the seal land 37D and the seal end 37B. The seal land 37D may be connected to the recessed section 21B via a sloped section 21C. An angle A1 defined between the sloped section 21C and the seal land 37D may be selected to avoid the detachment of the flow flowing through the seal 37 and along the sloped section 21C. The angle A1 is preferably 45 degrees or less. In some embodiments, the angle A1 ranges from 10 degrees to 15 degrees.

In some other embodiments, both of the low-pressure shaft 21 and the peripheral face 31B may define a recessed section to create the radial clearance 40. The deflector 39 may be an integral part of the low-pressure shaft 21.

Figure 3:
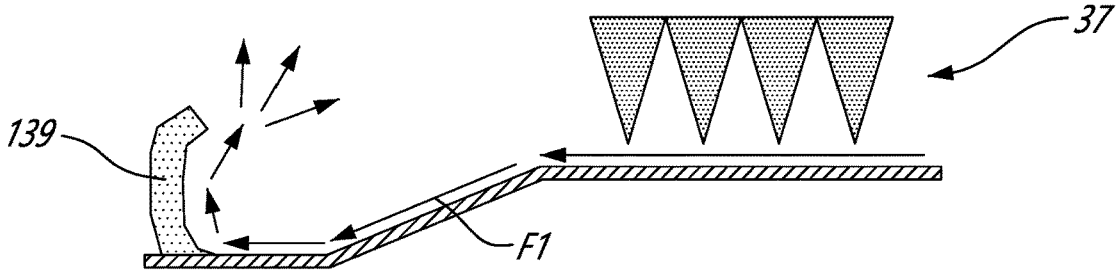
FIG. 3 is a cross-sectional view of another integration of a seal and a deflector in accordance with another embodiment.

Referring now to FIG. 3, another embodiment of a deflector is shown at 139. As illustrated, the deflector 139 defines a curved shape to better redirect the flow flowing past the seal 37 along the flow direction F1. Such a flow deflector 139 may more smoothly deflect the flow.

Figure 4:
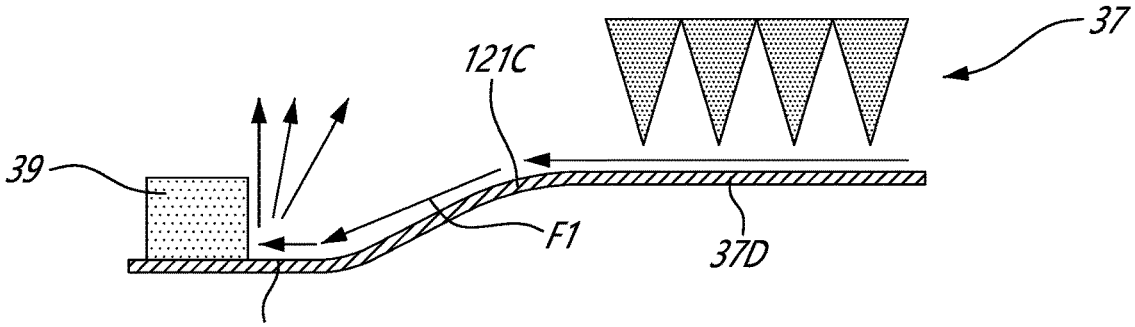
FIG. 4 is a cross-sectional view of another integration of a seal and a deflector in accordance with another embodiment.

Referring now to FIG. 4, in the embodiment shown, the sloped section 121C may smoothly merge to both of the seal land 37D and the recessed section 21B. In other words, axial ends of the sloped section 121C may be tangential to the seal land 37D and the recessed section 21B.

Figure 5:
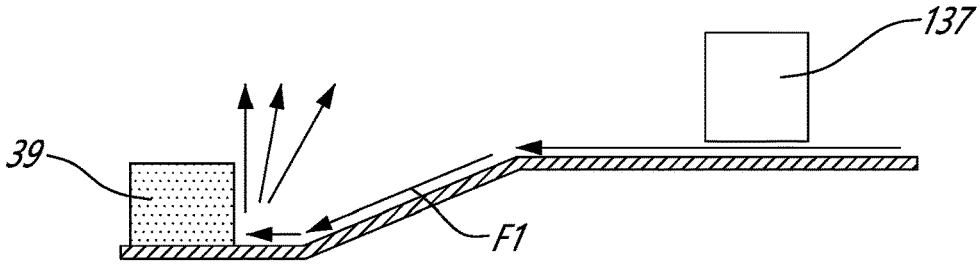
FIG. 5 is a cross-sectional view of another integration of a seal and a deflector in accordance with still another embodiment.

Referring now to FIG. 5, in the embodiment shown, the seal 137 is a controlled gap seal. But, as mentioned above, any other type of seal may be used.

Figure 6:
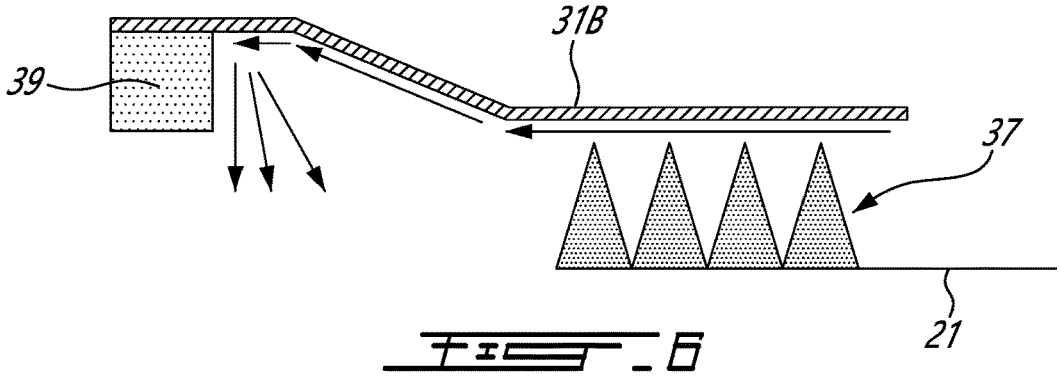
FIG. 6 is a cross-sectional view of another integration of a seal and a deflector in accordance with yet another embodiment.

Referring now to FIG. 6, in the present embodiment, the deflector 39 is secured to the impeller 31 and the seal 37 is secured to the low-pressure shaft 21. The recessed and sloped sections 21B, 21C are herein defined by the peripheral face 31B of the bore of the impeller 31.

Figure 7:
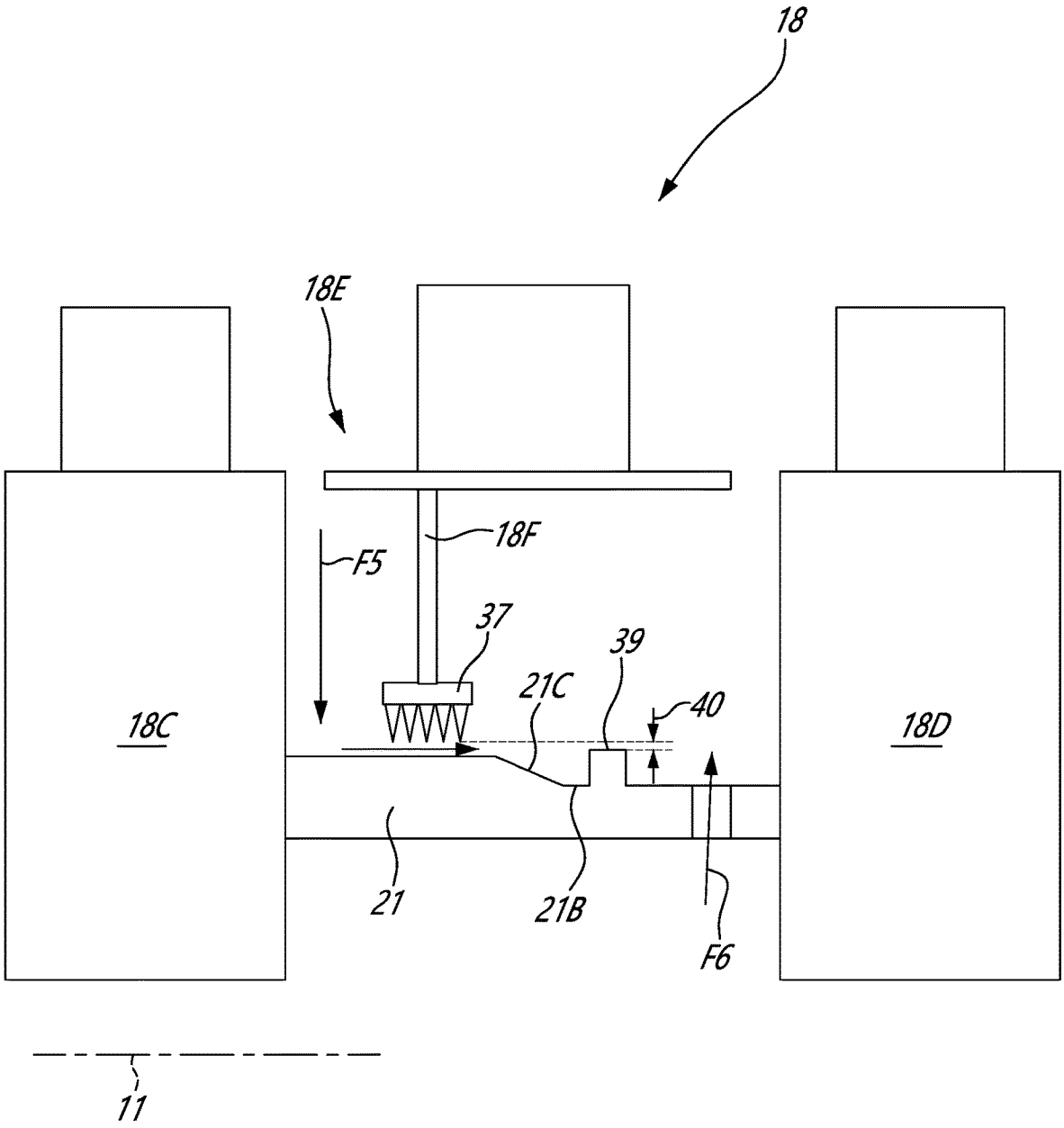
FIG. 7 is a cross-sectional view of a turbine section of the aircraft engine of FIG. 1.

Referring now to FIG. 7, another implementation of the seal 37 and deflector 39 is shown in the turbine section 18 of the gas turbine engine 10. As shown, the turbine section 18 includes two rotor discs 18C, 18D, which are herein part of the low-pressure turbine 18B, but may alternatively be part of the high-pressure turbine 18A. These two discs may be part of a turbine section comprising one or more additional discs located either upstream, downstream, or both. As shown, a stator 18E is disposed axially between the two rotor discs 18C, 18D. The seal 37 may be secured to a flange 18F of the stator 18E. In this embodiment, the first component corresponds to the flange 18F and the second component to the low-pressure shaft 21, or alternatively to the high-pressure shaft 20, connecting the two turbine discs 18C, 18D together. The two zones at different pressures are disposed on respective opposite sides of the flange 18F of the stator 18E. The deflector 39 may be used for mixing a flow of combustion gases ingested along fifth flow direction F5 and a cooling air flow flowing along sixth flow direction F6. The air exiting apertures defined through the shaft 21 along the sixth flow direction F6 may be the same air flowing within the shaft along the fourth flow direction F4

(FIG. 2). The radial clearance 40 is provided between the seal end and the deflector end.

It will be appreciated that the principles of the present disclosure, including the radial clearance between the seal end and the deflector end, may be provided at a plurality of locations inside the gas turbine engine 10. For instance, this configuration may be provided as part of the fan 12, within the low-pressure compressor 14B, the high-pressure compressor 14A as described above with reference to FIG. 2, inwardly of the combustor 16, under a diffuser case, within the low-pressure turbine 18B as described above, within the high-pressure turbine 18A, within an exhaust case, and so on.

Figure 8:
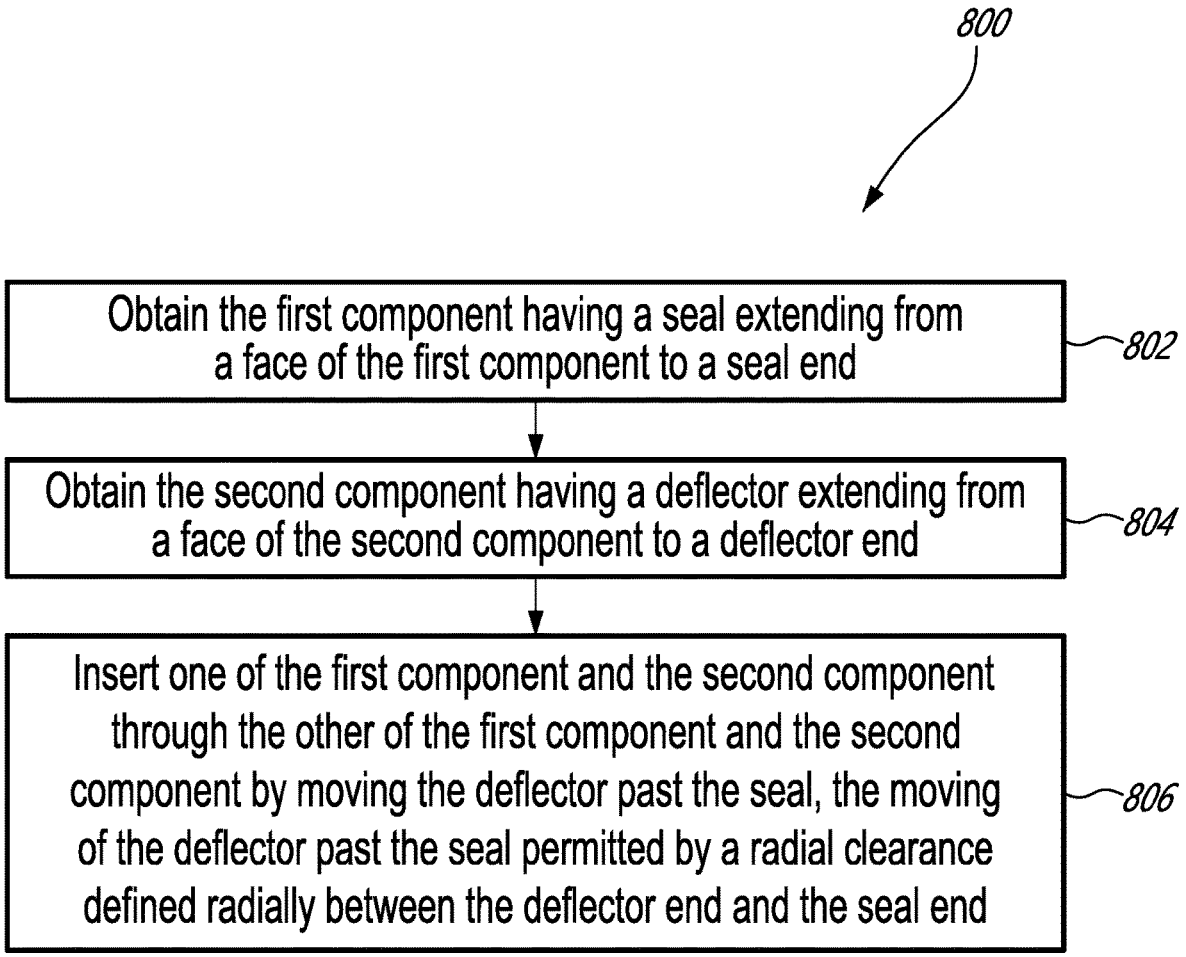
FIG. 8 is a flowchart illustrating steps of assembling the aircraft engine of FIG. 1.

Referring now to FIG. 8, a method of assembling the gas turbine engine 10 is shown at 800. The method 800 includes obtaining the first component 31 having the seal 37 extending from a face of the first component 31 to a seal end 37B at 802; obtaining the second component 32 having the deflector 39 extending from a face of the second component 32 to a deflector end 39B at 804; and inserting one of the first component 31 and the second component 32 through the other of the first component 31 and the second component 32 by moving the deflector 39 past the seal 37, the moving of the deflector past the seal permitted by a radial clearance defined radially between the deflector end 39B and the seal end 37B at 806.

In the embodiment shown, the obtaining of the second component 32 includes obtaining the second component 32 having the recessed section 21B. The deflector 39 secured to the recessed section 21B. A radial distance between the recessed section 21B and the seal end 37B greater than a radial clearance defined between the seal land 37D and the seal end 37B.

Herein, the obtaining of the second component 32 having the recessed section 21B includes obtaining the second component 32 having the sloped section 21C between the seal land 37D and the recessed section 21B.

The embodiments described in this document provide non-limiting examples of possible implementations of the present technology. Upon review of the present disclosure, a person of ordinary skill in the art will recognize that changes may be made to the embodiments described herein without departing from the scope of the present technology. In some other embodiments, the downstream side of the seal may be either a dry cavity, or a wetted cavity (e.g., mixture of oil and air). Yet further modifications could be implemented by a person of ordinary skill in the art in view of the present disclosure, which modifications would be within the scope of the present technology.

The invention claimed is:

1. A compressor section, comprising:

a rotor defining a bore;

a shaft extending through the bore;

a flow passage in fluid flow communication with an annular gap defined radially between the rotor and the shaft, the flow passage fluidly connecting a first zone and a second zone;

a seal disposed in the flow passage between the first zone and the second zone, the seal extending from a seal base secured to one of the rotor and the shaft to a seal end radially spaced apart from the seal base;

a deflector located downstream of the seal relative to a first flow of air flowing from the first zone to the second zone through the seal, the deflector extending from a deflector base secured to the other of the rotor and the shaft to a deflector end radially spaced apart from the deflector base; and a radial gap defined radially between the seal end and the deflector end.

2. The compressor section of claim 1, wherein the other of the rotor and the shaft defines a recessed section, the deflector secured to the recessed section.

3. The compressor section of claim 2, wherein the other of the rotor and the shaft defines a seal land facing the seal, a radial distance between the recessed section and the seal end greater than a radial clearance defined between the seal land and the seal end.

4. The compressor section of claim 2, wherein the other of the rotor and the shaft defines a sloped section connecting a seal land facing the seal and the recessed section.

5. The compressor section of claim 4, wherein an angle defined between the sloped section and the seal land is selected to avoid detachment of the first flow of air flowing along the sloped section.

6. The compressor section of claim 1, wherein the flow passage receives the first flow from the first zone, receives a second flow at a temperature different than that of the first flow, the flow passage has an outlet receiving a mixture of the first flow and the second flow.

7. The compressor section of claim 6, wherein the outlet is located downstream of the deflector relative to the first flow.

8. The compressor section of claim 1, wherein the seal is secured to the rotor and the deflector is secured to or integral to the shaft.

9. The compressor section of claim 1, wherein the seal is a labyrinth seal, a controlled gap seal, a carbon seal, or a brush seal.

10. A turbine section, comprising:

a rotor defining a bore;

a shaft extending through the bore;

a flow passage in fluid flow communication with an annular gap defined radially between the rotor and the shaft, the flow passage fluidly connecting a first zone and a second zone;

a seal disposed in the flow passage between the first zone and the second zone, the seal extending from a seal base secured to one of the rotor and the shaft to a seal end radially spaced apart from the seal base;

a deflector located downstream of the seal relative to a first flow of air flowing from the first zone to the second zone through the seal, the deflector extending from a deflector base secured to the other of the rotor and the shaft to a deflector end radially spaced apart from the deflector base; and a radial gap defined radially between the seal end and the deflector end.

11. The turbine section of claim 10, wherein the other of the rotor and the shaft defines a recessed section, the deflector disposed in the recessed section.

12. The turbine section of claim 11, wherein the other of the rotor and the shaft defines a seal land facing the seal, a radial distance between the recessed section and the seal end greater than a radial clearance defined between the seal land and the seal end.

13. The turbine section of claim 11, wherein the other of the rotor and the shaft defines a sloped section connecting a seal land facing the seal and the recessed section.

14. The turbine section of claim 13, wherein an angle defined between the sloped section and the seal land is selected to avoid detachment of the first flow of air flowing along the sloped section.

15. The turbine section of claim 10, wherein the flow passage receives the first flow from the first zone, receives a second flow at a temperature different than that of the first flow, the deflector disposed to promote mixing of the first flow with the second flow in the flow passage to obtain a mixture, and wherein the flow passage has an outlet receiving the mixture.

16. The turbine section of claim 15, wherein the outlet is located downstream of the deflector relative to the first flow.

17. The turbine section of claim 10, wherein the seal is secured to the rotor and the deflector is secured to or integral to the shaft.

18. The turbine section of claim 10, wherein the seal is a labyrinth seal, a controlled gap seal, a carbon seal, or a brush seal.

* * * * *